US006360629B2

(12) United States Patent
Schambre et al.

(10) Patent No.: US 6,360,629 B2
(45) Date of Patent: Mar. 26, 2002

(54) ADJUSTABLE PEDAL APPARATUS

(75) Inventors: John Schambre; David L. Garber, both of Canton; Dwight S. Brooks, New Boston; Liliana Neag, Walled Lake; Michael O. Forker, Novi; L. Guy Montford, Canton; Jack Soullier, Troy; Howard A. Estes, Jr., Ann Arbor, all of MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/283,481

(22) Filed: Apr. 1, 1999

(51) Int. Cl.[7] ..... G05G 1/14

(52) U.S. Cl. ..... 74/512; 74/513; 74/560; 74/519

(58) Field of Search ..... 74/512, 575, 577 S, 74/578, 542, 577 M, 513, 560; 123/399

(56) References Cited

U.S. PATENT DOCUMENTS

| | | | | | |
|---|---|---|---|---|---|
| 3,643,524 | A | | 2/1972 | Herring | |
| 3,643,525 | A | | 2/1972 | Gibas | |
| 3,691,868 | A | | 9/1972 | Smith | |
| 3,944,012 | A | * | 3/1976 | La Chiusa | 188/77 R |
| 4,394,004 | A | * | 7/1983 | Allen et al. | 254/204 |
| 4,437,267 | A | * | 3/1984 | Corley | 51/34 R |
| 4,591,288 | A | * | 5/1986 | Schmidek et al. | 403/260 |
| 4,609,212 | A | * | 9/1986 | Hosang et al. | 285/334 |
| 4,610,585 | A | * | 9/1986 | Fellmeth et al. | 409/233 |
| 4,870,871 | A | | 10/1989 | Ivan | |
| 4,875,385 | A | | 10/1989 | Sitrin | |
| 4,989,474 | A | | 2/1991 | Cicotte et al. | |
| 5,010,782 | A | | 4/1991 | Asano et al. | |
| 5,078,024 | A | | 1/1992 | Cicotte et al. | |
| 5,131,288 | A | * | 7/1992 | Barlas | 74/512 |
| 5,327,797 | A | * | 7/1994 | Seifrit | 74/512 |
| 5,351,573 | A | | 10/1994 | Cicotte | |
| 5,460,061 | A | | 10/1995 | Redding et al. | |
| 5,555,773 | A | * | 9/1996 | Nanno et al. | 74/512 |
| 5,588,335 | A | * | 12/1996 | Strait | 74/575 X |
| 5,632,183 | A | | 5/1997 | Rixon et al. | |
| 5,649,453 | A | * | 7/1997 | Kanbe | 74/516 X |
| 5,676,220 | A | | 10/1997 | Dapsi et al. | |
| 5,697,260 | A | | 12/1997 | Rixon et al. | |
| 5,722,302 | A | | 3/1998 | Rixon et al. | |
| 5,771,752 | A | | 6/1998 | Cicotte | |
| 5,887,488 | A | * | 3/1999 | Riggle | 123/399 |
| 5,996,438 | A | * | 12/1999 | Elton | 74/560 X |
| 5,996,439 | A | * | 12/1999 | Elton et al. | 74/513 X |

FOREIGN PATENT DOCUMENTS

| | | | | |
|---|---|---|---|---|
| JP | 2-39215 | * | 2/1990 | 74/512 |

OTHER PUBLICATIONS

*Automotive News*, Feb. 15, 1999, "Move the pedal, not the seat . . Teleflex Automotive Group, Warren, Mich.", Crain Communications, Inc.

* cited by examiner

*Primary Examiner*—Vinh T. Luong
(74) *Attorney, Agent, or Firm*—Mark P. Calcaterra

(57) ABSTRACT

An adjustable pedal apparatus for a motor vehicle. The apparatus includes a pedal that can be translated in a longitudinal fashion parallel to the vehicle floor. The pedal is translated by use of a screw that is threadedly attached to the pedal and also pivotally attached to a motion linkage. The position and movement of the motion linkage is uniform irrespective of the longitudinal position of the pedal. The pedal includes a pivot pin that is received by a slot formed in a body structure; translation of the pedal along screw causes longitudinal movement of the pivot pin the said slot. The pivot pin is free to translate within said slot while the pedal is not depressed, when the pedal is depressed the pivot pin becomes fixed longitudinally by a camming formation and locking element arrangement. This allows depression of the pedal to cause the pedal to pivot about the pivot pin.

12 Claims, 5 Drawing Sheets

FIG-7
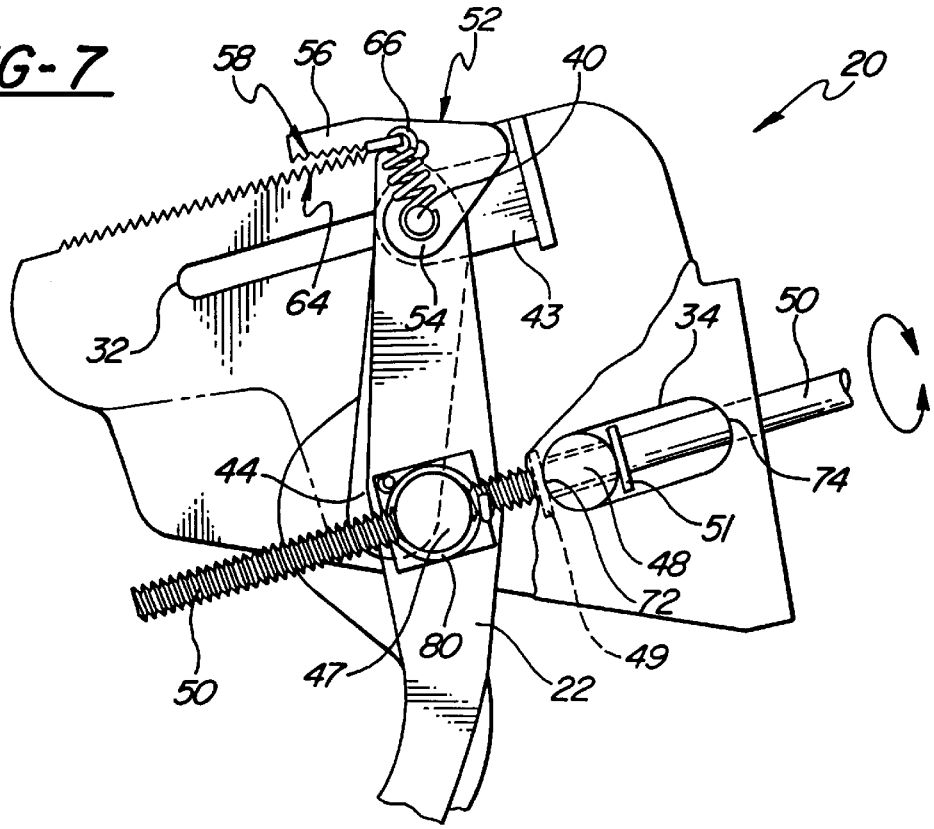
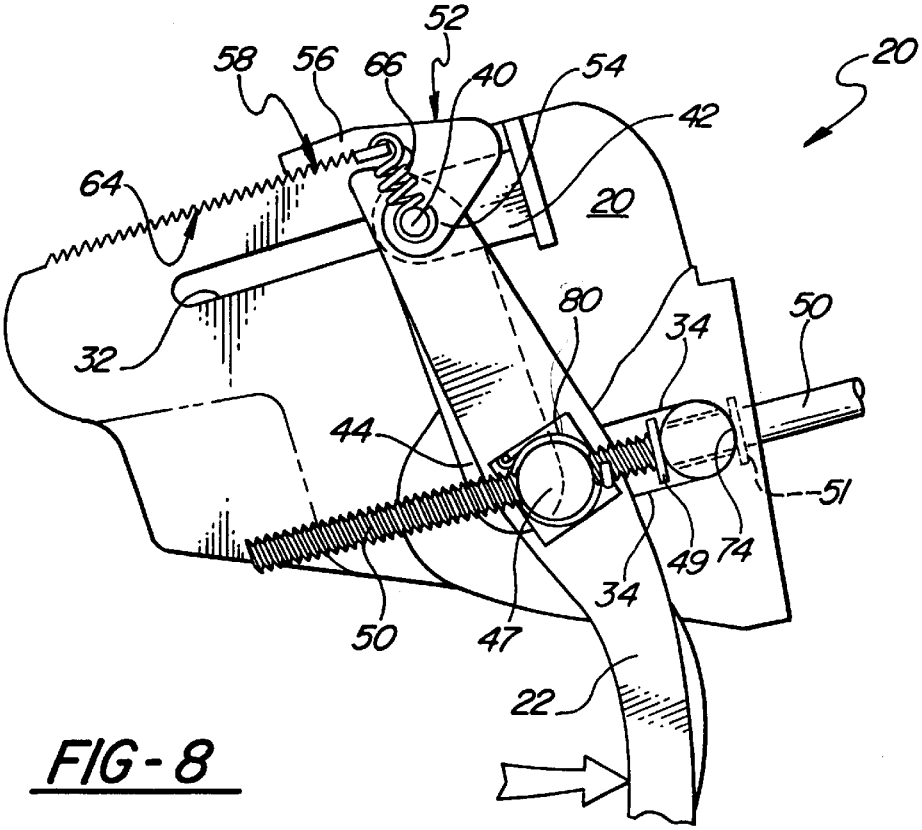
FIG-8

ADJUSTABLE PEDAL APPARATUS

BACKGROUND OF THE INVENTION

1. Technical Field

The present invention relates in general to motor vehicle pedals. More particularly, but without restriction to the particular embodiment and/or use which is shown and described for purposes of illustration, the present invention relates to pedal systems that provide for adjustment of the brake, clutch, or accelerator pedal relative to a vehicle driver.

2. Discussion

In a conventional automobile, pedals are provided for controlling the acceleration and braking functions of the vehicle. If the vehicle includes a manual transmission, a clutch pedal is typically provided. In most motor vehicles today, the pedals have fixed locations. Typically, these pedals are fixed to the body of the vehicle at a point, so that the pedal will pivot about the fixed point when foot pressure is applied by the operator. In order to accommodate driver's of varying physiques, the driver's seat is, generally, slidingly engaged to the vehicle such that a driver can position himself or herself relative to either the steering wheel or the pedals. This adjustment provides, to a certain degree, an improvement of driver comfort.

However, it is nearly impossible to such a single adjustment to accommodate all possible variances in human physiques. In particular, the proportional relation between the lengths of a driver's arms and legs in relation to the drivers overall torso size cannot be accommodated through a single adjustment. For example, many smaller people have small legs. Therefore, when they drive a motor vehicle, they must position the seat in its foremost position to properly reach the pedals. Unfortunately, their arms and torso are typically too close to the steering wheel of the vehicle to be comfortable. Accordingly, it has been widely recognized that some type of pedal adjustment is desirable to provide optimal comfort to the driver while he or she is operating the vehicle.

Many approaches to providing adjustable pedals have been suggested in the prior art. The most common approach is to provide some type of pushrod, ratcheting, or camming device so that the pedal will operate in a different pivotal range. By utilizing such a device, the static position of the pedal can be modified in the forward and rearward direction. An example of this approach is provided in U.S. Pat. No. 5,771,752, issued Jun. 30, 1998. Although, in general, this type of system works satisfactorily in providing an adjustable pedal, the distance of the pedal to the floor will change as the pedal is pivoted. This may be not desirable because it changes the angle at which foot pressure needs to be applied, and may affect the angle at which the master cylinder pushrod for a brake pedal is activated.

Many other adjustable pedal systems have been developed in the recent years that provide a linear movement of the pedals so as to maintain the relationship between the pedal and floor. A few examples of such applications can be found in U.S. Pat. No. 4,870,871, issued Oct. 3, 1989, U.S. Pat. No. 5,722,302, issued Mar. 3, 1998, and U.S. Pat. No. 5,010,782, issued Apr. 30, 1991. Although prior art devices such as those described above have proven to be successful, there is a need to develop a system that can be implemented on a vehicle currently in production while, effective, robust, and compact enough to be used in future vehicle development efforts. The present invention also represents substantial improvements over the pedal design disclosed in the aforementioned patents.

SUMMARY OF THE INVENTION

Accordingly, it is a principal objective of the present invention to provide a truly versatile and effective adjustable pedal apparatus for use in a motor vehicle.

It is another objective of the present invention to provide an adjustable pedal apparatus that can mimic the action of a standard pedal to the master cylinder pushrod while being linearly adjustable in the longitudinal direction.

It is still another objective of the present invention to provide an adjustable pedal apparatus that includes structure to lock the pivot pin of the pedal in position only while the pedal is depressed.

It is a further objective of the present invention to provide an adjustable pedal apparatus that can be utilized in an existing vehicle with minimal modification, while effective, robust, and compact enough to be utilized in future vehicle development efforts.

In one form, the present invention provides an adjustable pedal apparatus for a motor vehicle. The apparatus includes a pedal having a pivot pin disposed near the top end thereof and a footpad disposed near the bottom end thereof. The pedal can be translated in a longitudinal manner parallel to the floor of the motor vehicle. The apparatus also includes a body structure that is attached to the body or chassis of the motor vehicle. The body structure includes a first and second longitudinally extending slots, the first being elevated from the second. The elevated first slot is adapted to receive the pivot pin and to allow for movement of said pivot pin within said first slot. The body structure also has a motion linkage pivotally connected thereto. The pivoting of the motion linkage is designed to mimic the swing of a non-adjustable brake pedal. A tie rod is pivotally attached to the motion linkage and pivotally attached to an attaching unit that is disposed about a screw. The screw extends from the attaching unit and is pivotally and threadedly attached to the pedal via a threaded unit. The attaching unit is received by the second longitudinally extending slot in the body structure. Attaching unit is fixed in position by flanges disposed on the screw. Attaching unit includes a bore of a diameter greater than that of the screw, such that the screw is allowed to rotate freely therein. The pushrod controlling the desired vehicle function is attached to either the tie rod or the motion linkage. This will provide uniform motion for the pushrod when the pedal is depressed irrespective of the longitudinal location of the pedal. A motor is attached to the screw to cause movement of the pedal about the screw. As the screw is translated rearward the attaching unit contacts an abutment formed by the second slot and forces the threaded pedal attachment to translate the pedal rearward. Accordingly, the pivot pin in the first slot translates rearward therewith. As the screw is translated forward the pushrod keeps the attaching unit substantially in place while the pedal, including the pivot pin in the first slot, is translated forward. When the pedal is in the static or non-depressed position the pivot pin is free to translate within the first slot. As soon as the pedal is depressed the pivot pin is locked in place. This is accomplished by a cam, locking mechanism, and spring arrangement. A series of teeth are disposed on the body structure above the first slot, and a lever having mating teeth is pivotally attached to the pedal. The lever is biased towards the pedal by interconnecting the pivot pin and the lever by a spring element. The spring element ensures contact between the teeth on the body structure and the mating teeth on the lever while the pedal is depressed. When the pedal is not depressed, i.e. the static position, a cam formation on the top portion of the pedal contacts the lever.

The cam formation acts against the biasing force of the spring to disengage the two sets of teeth, thereby allowing the pivot pint to translate freely within the first slot. It can be appreciated that longitudinal movement of the pedal is designed to occur only when the pedal is in the static position.

Additional benefits and advantages of the present invention will become apparent to those skilled in the art to which this invention relates from a reading of the subsequent description of the preferred embodiment and the appended claims, taken in conjunction with the accompanying drawings.

BRIEF DESCRIPTION OF THE DRAWINGS

FIG. 7 is a side view of the adjustable pedal apparatus illustrating the pedal in the full rearward location and in the static or position; and FIG. 8 is a side view of the adjustable pedal apparatus illustrating the pedal in the full rearward location and in the fully depressed position.

DETAILED DESCRIPTION OF THE PREFERRED EMBODIMENT

Figure 1:
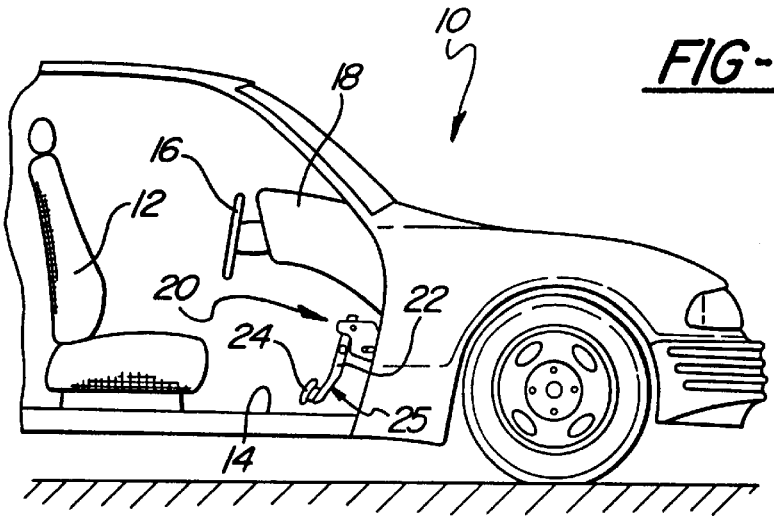
FIG. 1 is a side view of a motor vehicle.

Referring now to the drawings, there is depicted an adjustable pedal apparatus illustrating the preferred embodiment of the present invention. Turning first to FIG. 1, a motor vehicle 10 is shown. Vehicle 10 includes a driver's seat 12 slidingly engaged to the floor 14 of vehicle 10. Vehicle 10 also includes a steering vehicle 16 extending from an instrument panel 18. Disposed below instrument panel 18 and above floor 14 is an adjustable pedal apparatus 20. Apparatus 20 includes a pedal 22 having a foot pad 24 on the bottom end 25 thereof. In the preferred embodiment, pedal 22 operates the braking functions of the vehicle. It should be appreciated that the teachings of this invention can be utilized on acceleration and clutch pedals as well as brake pedals.

Figure 2:
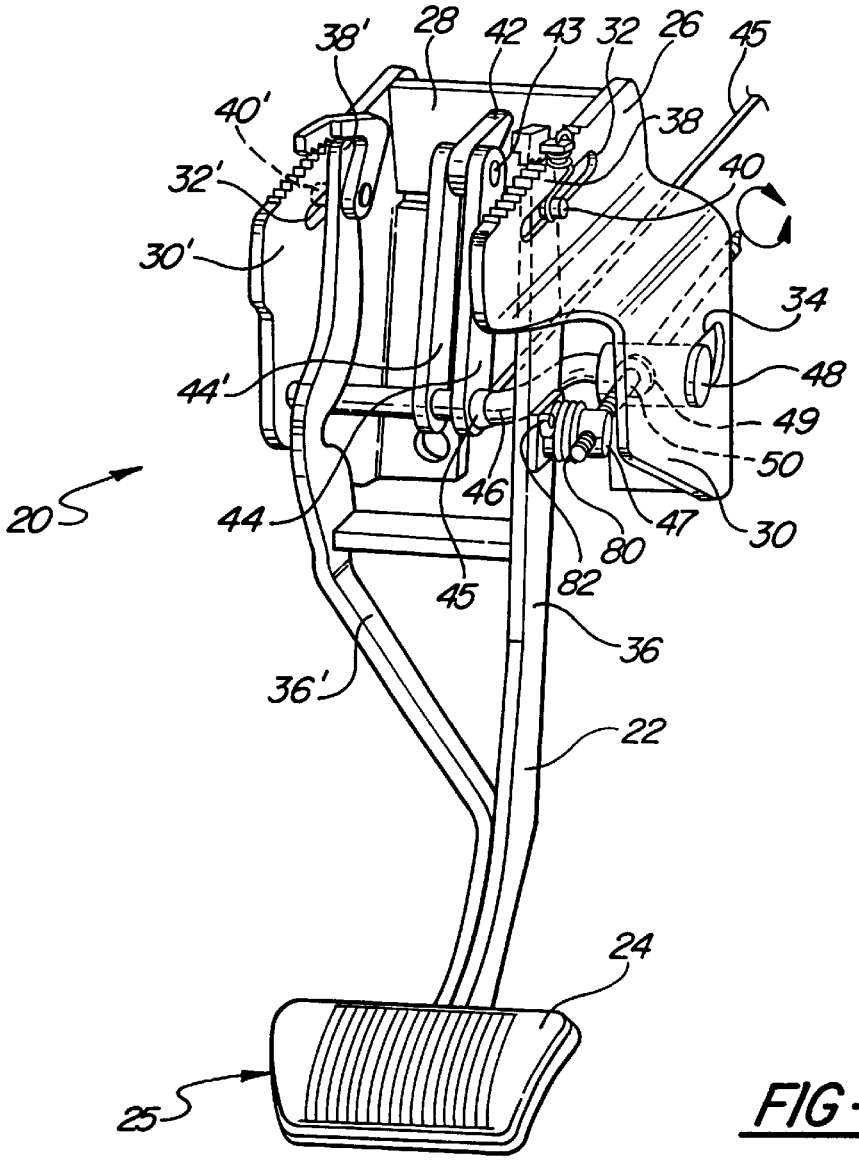
FIG. 2 is a perspective view of the adjustable pedal apparatus.

Turning to FIG. 2, a perspective view of apparatus 20 is illustrated. Apparatus 20 includes a body structure 26 that is attached to vehicle 10, preferably by bolts. Body structure 26 has a base formation 28 with two opposing walls 30 and 30' projecting therefrom. Each wall 30 and 30' includes a first longitudinally extending slot 32 and 32'. Wall 30 further includes a second longitudinally extending slot 34 disposed vertically below first slot 32.

Pedal 22 is formed such that it has two upwardly extended arms 36 and 36'. The span of arms 36 and 36' is slightly less than the distance between opposing walls 30 and 30'. Each arm 36 and 36' terminates in a cam formation 38 and 38'. The cam formations 38 and 38' are curved in a way to effectively reduce the height of the top edge of the arm 36 and 36' as the pedal 22 is pivoted by depression thereof. Each arm 36 and 36' also includes a pivot pin 40 and 40' near the top end 41 thereof. Pivot pins 40 and 40' are, preferably, cylindrical projections from arms 36 and 36' and adapted to be received within first slots 32 and 32'. It should be appreciated that the diameter of the pivots pins 40 and 40' is just slightly less than the height of the first slot 32 and 32'.

Body structure 26 includes a flange 42 extending from the base formation 28 thereof. Pivotally attached to flange 42 at hinge 43 are a pair of motion linkages 44 and 44'. Motion linkages 44 and 44' are attached to flange 42 at their top end and extend downward and terminate around a pivotal attachment to a tie rod 46. Tie rod 46 extends laterally, as well as rearwardly in some locales, and terminates on one end in a pivotal attachment to an attaching unit 48. Attaching unit 48 is adapted to receive a translational structure screw 50. As previously described, the attaching unit 48 is disposed about the screw 50. Attaching unit includes a bore of a diameter greater than that of the screw, such that the screw is allowed to rotate freely therein. Screw 50 includes two circular flanges 49 and 51 extending therefrom. Flanges 49 and 51 lock attaching unit 48 in place along screw 50. Screw 50 extends forward from attaching unit 48 to a pivotal attachment to arm 36 of pedal 22. Screw 50 extends through threaded unit 47, threaded unit 47 is pivotally attached to pedal 22. As screw 50 is rotated, pedal 22 will translate thereon due to the threaded attachment. Therefore, as screw 50 is rotated in a first direction, pedal 22 is translated rearward; and as screw 50 is rotated in a second direction, pedal 22 is translated forward.

It should be appreciated that the translation of pedal relative to the screw can be achieved in a variety of different ways. For example, in another embodiment, the attaching unit 48 can be threaded and the threaded unit 47 can include a bearing race instead of being threaded. Furthermore, screw 50 may be replaced by any structure that allows translation thereon. Moreover, the screw 50 or translation structure does not need to be motorized, as long as there is some means of translating the units upon the translational structure. Another embodiment may include a threaded attachment in both the attaching unit and the threaded unit that is utilized with a screw having portions threaded in one direction and portions threaded in the other direction, whereby rotation of the screw would cause the units to translate towards each other or to translate away from each other.

Figure 3:
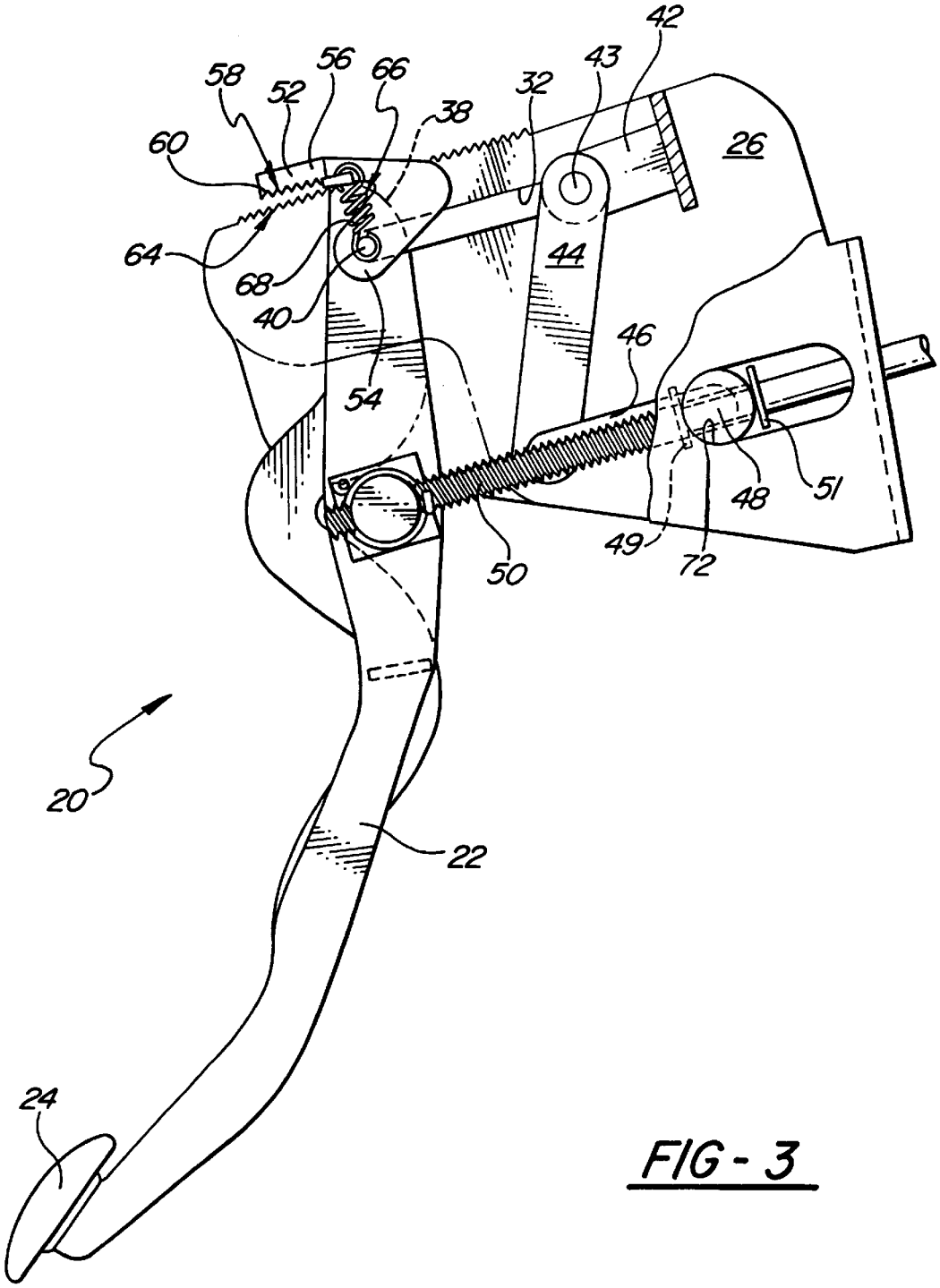
FIG. 3 is a side view of the adjustable pedal apparatus illustrating the pedal in the full forward location and in the static or non-depressed position.

FIG. 3 illustrates apparatus 20 with pedal 22 in the full forward location. Pedal 22 is non-depressed or static position, in other words, no pressure is placed on foot pad 24 of pedal 22 that would depress the pedal and activate the vehicle function controlled by pedal 22. With pedal 22 in its full forward position, pivot pin 40 is disposed at the forwardmost end of first slot 32.

Figure 4:
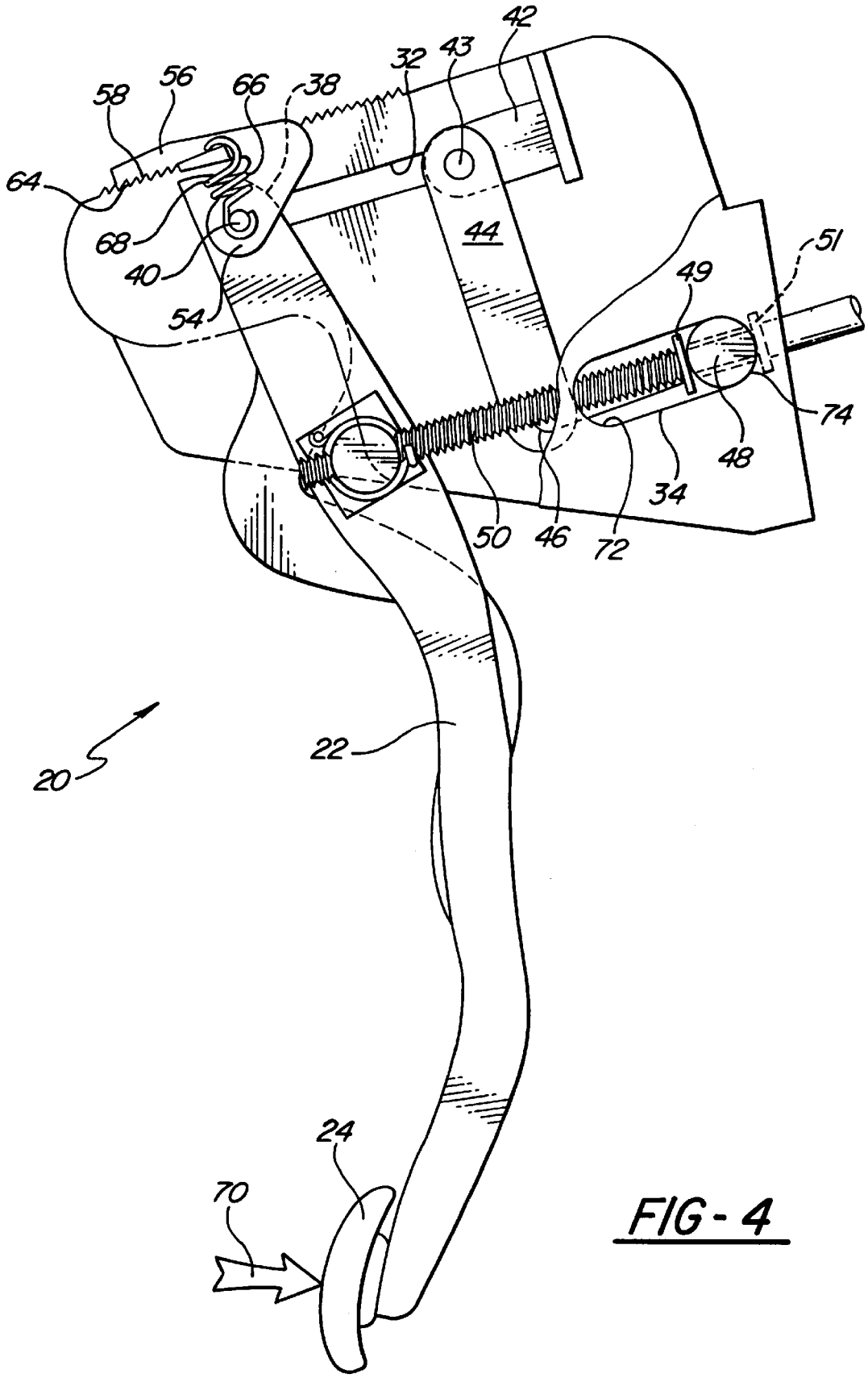
FIG. 4 is a side view of is a side view of the adjustable pedal apparatus illustrating the pedal in the full forward location and in the fully depressed position.

This position of pivot pin 40 will stay constant even when foot pressure is placed on foot pad 24 to depress pedal 22. When pedal 22 begins to be depressed, cam formation 38 effectively lowers lever 52. Lever 52 is v-shaped and pivotally attached to pedal 22 one its lower prong 54. Preferably, lever 52 is pivotally attached to pivot pin 40. The upper prong 56 includes a locking element 58 disposed on the lower surface thereof. Locking element 58 is formed by teeth 60. The top surface 62 of body structure 26 has a locking element 64 disposed above first slot 32 and extending substantially the length of slot 32. Locking element 58 is adapted to mate with locking element 64 to ensure the position of pivot pin 40 when pedal 22 is depressed. A biasing element 66 urges contact between locking element 64 and its mating locking element 58. When the pedal 22 is in the static or non-depressed position, the cam formation 38 acts against biasing element 66 to interrupt the contact between locking elements 58 and 64, as illustrated in FIG. 3. As the pedal is depressed, cam formation 38 effectively lowers so that biasing element 66 can establish cooperation between locking elements 58 and 64 so as to secure the longitudinal position of pivot pin 40 within first slot 32, as illustrated in FIG. 4. Biasing element 66 is comprised of a spring 68 interconnecting upper prong 56 of lever 52 and pedal 22. Spring 68, preferably, attaches to pedal 22 at pivot pin 40.

FIG. 4 illustrates pedal 22 in the full forward location with foot pressure 70 applied to foot pad 24. Pedal 22 is termed fully depressed in this illustration. As the pedal 22 is depressed from its static position, FIG. 3, cam formation 38 effectively lowers so that biasing element 66 can establish cooperation between locking elements 58 and 64 so as to secure the longitudinally position of pivot pin 40. The vertical position of pivot pin 40 is secured by slot 32. Therefore, the only movement available is pivoting of pedal 22 about pivot pin 40. The depression of pedal 22 also causes the attaching unit 48, due to its link with pedal 22 by screw 50, to move rearward within second slot 34. In the static position, attaching unit 48 is located against abutment 72 of second slot 34. During depression of pedal 22, attaching unit 48 travels until it contacts rear abutment 74 of second slot 34. It can be appreciated that the length of second slot 34 effectively establishes the maximum amount of throw for pedal 22. It should as be appreciated that as pedal 22 is depressed, threaded unit 47 pivots about its attachment to pedal 22. During pedal 22 depression, motion linkages 44 pivot about hinge 43 formed with flange 42. This motion is attributed to tie rod 46 linking attaching unit 48 and motion linkages 44. A pushrod 45 (shown in FIG. 2) is preferably pivotally attached to either tie rod 46 or to motion linkages 44. Force from the motion linkages 44 or tie rod 46 upon the pushrod 45 will activate the braking functions of vehicle 10 in the preferred embodiment. It should be appreciated that the motion linkages 44 and tie rod 66 move in a consistent manner during depression of pedal 22, irrespective of the location of pedal 22. It should also be appreciated that the motion linkages 44 effectively mimic the motion of a non-adjustable vehicle pedal. Due to the inherent nature of a brake pushrod 45 that is typically attached directly or indirectly to the master cylinder of the brake system, force is constantly provided from the brake system that encourages the pushrod 45 and thus pedal 22 to return to its static position. It should also be appreciated that a similar return force is available for an accelerator or clutch pedal, thus offering similar function of pedal 22.

Figure 5:
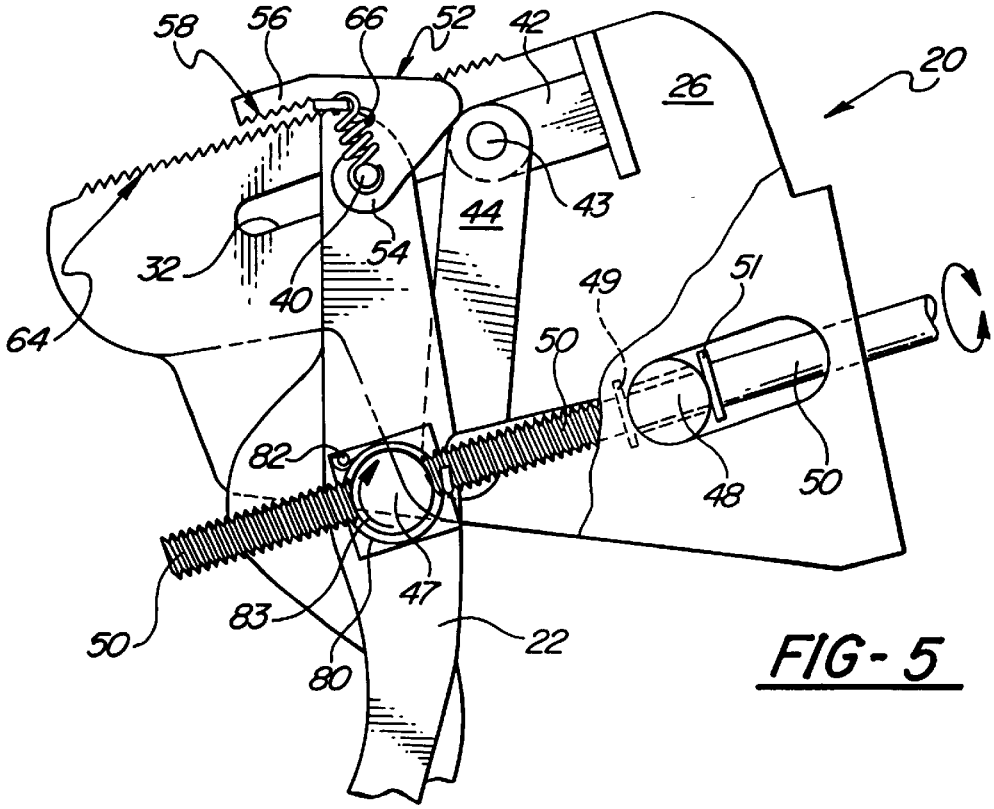
FIG. 5 is a side view of the adjustable pedal apparatus illustrating the pedal in an intermediate location and in the static position.

Turning now to FIG. 5 and its relation to FIG. 3, the translation of pedal 22 from a full forward location to an intermediate location is provided. When the pedal 22 is in the full forward location, it can be translated to an intermediate location by activation of screw 50. It should be appreciated that the present invention can create numerous intermediate locations between the full forward and full rearward locations. In the preferred embodiment, the screw 50 can be activated by a small electric motor or even manually. As screw 50 is rotated, threaded unit 47 is transitioned along screw 50. It can be appreciated that any means to translate threaded unit 47 along screw 50 would not deviate from the scope of the present invention. As threaded unit 47 is translated along screw 50, pedal 22 is translated therewith. As pedal 22 is forced rearward, pivot pin 40 slides rearward within first slot 32. It can be appreciated that precise tolerances are required for rearward movement of pedal 22 while retaining its axial orientation. It should also be appreciated that by pivotally attaching screw 50 to pedal 22 near its center also contributes to the ability of pedal 22 to maintain its axial orientation while moving rearward. It can further be appreciated that locking elements 58 and 64 are not engaged during the rearward movement of pedal 22. The engagement of locking elements 58 and 64 may hinder the forward or rearward movement of pedal 22. In fact, one can develop ways to electronically limit translation of threaded unit 47 along screw 50 when the pedal is depressed.

To aid in retaining the axial orientation of pedal 22 during translation, spring 80 is provided. Preferably, spring 80 attaches to a fixed projection 82 on the pedal and screw 50 to provide a force directed in a upward and backward direction, as indicated by arrow 83. This provides an added force to compel the top portion of the pedal 22 to translate consistent with the portion of the pedal 22 that is attached to the screw to insure retention of the axial orientation.

Figure 6:
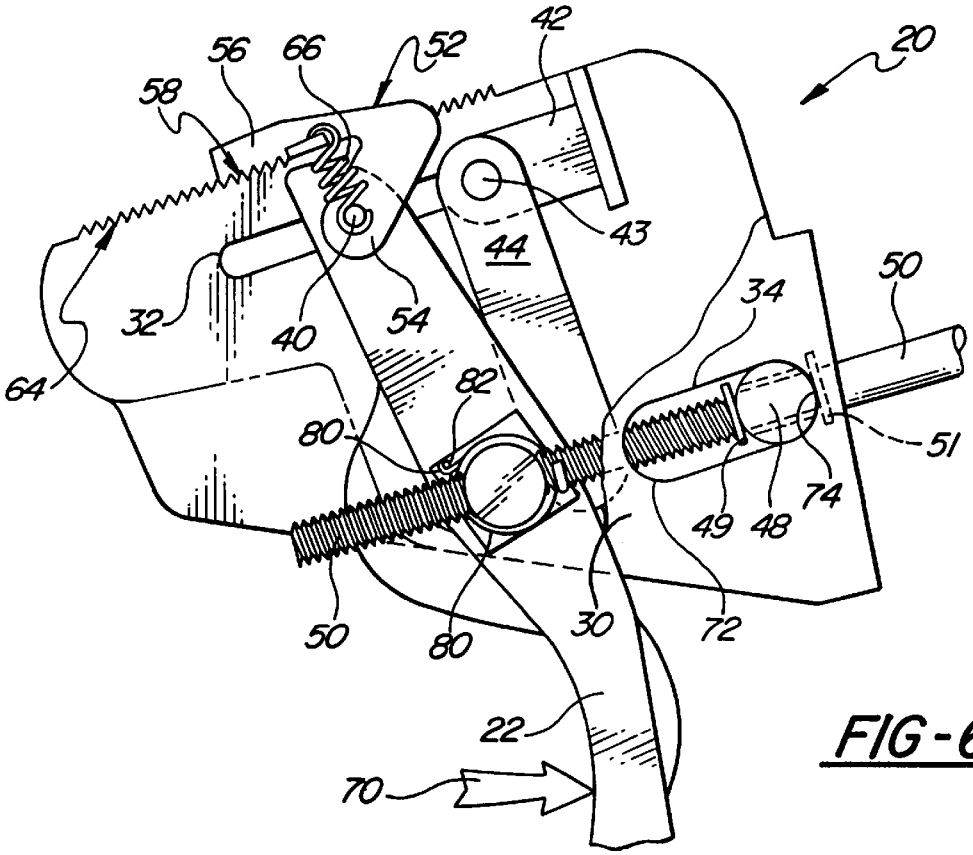
FIG. 6 is a side view of the adjustable pedal apparatus illustrating the pedal in an intermediate location and in the fully depressed position.

While in the intermediate location, the pedal can now be depressed as illustrated in FIG. 6. The depression of pedal 22 occurs in the same manner as outlined while the pedal 22 was in the full forward location. The only appreciable difference is that pedal 22 is now closer to attaching unit 48 and motion linkages 44.

FIG. 7 illustrates pedal 22 in its static position in its full rearward location. FIG. 8 illustrates pedal 22 in its fully depressed position in its full rearward location. The full rearward location is achieved from an intermediate position in a manner similar to that previously described when moving from the full forward position to an intermediate position. When transitioning between the full rearward location to an intermediate location, screw 50 is rotated in the opposite direction to cause threaded unit 47 to translate along screw in a direction away from attaching unit 48. Actual movement of attaching unit 48 is limited by the return force placed on the tie rod 46 or motion linkages 44 from the pushrod. This return force is sufficient enough to maintain attaching unit 48 against abutment 72 thereby causing pedal 22 to move forward.

While the above description constitutes the preferred embodiment of the invention, it will be appreciated that the invention is susceptible to modification, variation, and change without departing from the proper scope or fair meaning of the accompanying claims.

What is claimed is:

1. An adjustable pedal apparatus for a motor vehicle for providing rearward, a plurality of intermediate, and forward pedal position relative to an occupant, said appartus comprising:

a pedal having a pivot pin and a capable of being activated, said pedal adapted to pivot about said pivot pin in responce to the activation of said pedal;

a body structure having at least one first slot receiving said pivot pin and allowing transition of the pivot pin between rearward, a plurality of intermediate, and forward positions within the first slot;

a motion linkage pivotally attached to said body structure;

a translational structure pivotally connected to said pedal and pivotally connected to said motion linkage wherein said translational structure translates the pedal between rearward, a plurality of intermediate, and forward positions and correspondingly translates said pivot pin to slide longitudinally within said first slot while said motion linkage is stationary and said pedal is not activated; and a pushrod attached to said motion linkage so as to provide a constant force capable of maintaining the stationary position of the motion linkage until the pedal is activated and providing a constant force and motion during activation of said pedal independent of the position of said pedal and said pivot pin.

2. An apparatus as set forth in claim 1, wherein said translational structure is a screw.

3. An apparatus as set forth in claim 2, wherein said pivot pin is elevated from where said screw is pivotally and threadedly connected to said pedal.

4. An apparatus as set forth in claim 2, further comprising means to rotate said screw, wherein rotation of said screw will cause the pedal to longitudinally translate between rearward, a plurality of intermediate, and forward positions.

5. An apparatus as set forth in claim 2, further comprising a tie rod disposed between said motion linkage and said screw.

6. An apparatus as set forth in claim 5, further comprising an attaching unit disposed about said screw and pivotally attached to said tie rod, attaching unit is fixed in place on said screw by a pair of flanges extending from said screw.

7. An apparatus as set forth in claim 6, wherein said body structure includes a second slot for receiving said attaching unit, said second slot includes a front and rear abutment that limits the longitudinal movement of said attaching unit thereby limiting the throw of said pedal.

8. An adjustable pedal apparatus for a motor vehicle, said apparatus comprising:

a pedal having a pivot and a camming formation, said pedal having a static position and a plurality of depressed positions;

a body structure including a locking element disposed in a longitudinal manner;

a lever including a mating locking element adapted to cooperate with said locking element to hold said pivot of said pedal in a defined location; and a biasing element adapted to encourage cooperation between said locking element and said mating locking element;

wherein said camming formation of said pedal is adapted to contact said lever while said pedal is in said static position to eliminate said cooperation between said between said locking element and said mating locking element while allowing cooperation between said locking element and said mating locking element while said pedal is in a depressed position; said pedal includes a pivot pin that defines the pivot of said pedal, and said body structure includes a slot for reception of said pivot pin for limiting vertical movement of said pivot pin.

9. The apparatus as set forth in claim 8, wherein said cooperation between said locking element and said mating locking element limits longitudinal movement of said pivot pin.

10. The apparatus as set forth in claim 8, wherein said biasing element is disposed between said lever and said pedal.

11. The apparatus as set forth in claim 8, wherein said biasing element is a spring that moves longitudinally with said pedal.

12. An adjustable pedal system for a motor vehicle comprising:

a pedal having pivot pin disposed near the top end thereof and a foot pad disposed near the bottom thereof;

a body structure having a first longitudinally extending slot formed therein, said first longitudinally extending slot adapted for reception of said pivot pin so that pivot pin can freely slide within said first longitudinally extending slot, said body structure also having a second longitudinally extending slot having an end abutment, said body structure also having a locking element arrangement disposed near said first longitudinally extending slot;

a screw element pivotally attached to said pedal at a location below said pivot pin;

a spring attached to said screw element and said pedal to provide rotational force therebetween;

a motion linkage pivotally attached to said housing at one end thereof;

a tie rod pivotally engaged to said motion linkage and to said screw element, said tie rod being pivotally engaged to said screw element via a attaching unit, said second longitudinally extending slot adapted to receive said attaching unit and define the throw of said pedal;

motor means to rotate said screw element in order to translate said attaching unit along said screw element, wherein said translation causes said pedal to move in the longitudinal direction thereby causing said pivot pin of said pedal to move in the longitudinal direction within said first longitudinally extending slot;

a lever including a mating locking element pivotally connected to said pedal;

said pedal including a camming portion at said top end thereof to contact said lever while said pedal is in the static position to eliminate contact between said locking element of said body structure and said mating locking element of said lever to allow said pivot pin to slide freely within said first longitudinally extending slot of said body structure; and a biasing element disposed between said lever and said pedal to establish contact between said locking element of said body structure and said mating locking element of said lever while said lever is depressed.

* * * * *